United States Patent [19]

Haines et al.

[11] 4,074,828

[45] Feb. 21, 1978

[54] SEALING PLUG ASSEMBLY

[75] Inventors: Walter E. Haines, Bloomfield Hills; Mason E. Richardson, Warren, both of Mich.

[73] Assignee: Estan Manufacturing Company, Troy, Mich.

[21] Appl. No.: 751,012

[22] Filed: Dec. 16, 1976

[51] Int. Cl.[2] ..... B65D 43/08; B65D 51/18; F16L 55/10

[52] U.S. Cl. ..... 220/254; 138/89; 220/252; 220/253; 220/378

[58] Field of Search ..... 220/378, 234–239, 220/86 AT, 307, 233, 241, 242, 326, 278, 352, 358, 353, DIG. 19, 254, DIG. 32; 138/89; 123/198 R, 198 E; 184/88 R, 94, 105 B

[56] References Cited

U.S. PATENT DOCUMENTS

| | | | |
|---|---|---|---|
| 172,528 | 1/1876 | Walker | 220/234 |
| 351,414 | 10/1886 | Warner | 220/235 |
| 739,589 | 9/1903 | Clifford | 220/237 |
| 775,124 | 11/1904 | Christman | 220/237 |
| 2,773,554 | 12/1956 | Lindorf | 220/235 |
| 2,831,619 | 4/1958 | Cowle | 220/235 |
| 2,937,386 | 5/1960 | Perretz | 220/307 |
| 3,016,162 | 1/1962 | Cioffi | 220/86 AT |
| 3,343,712 | 9/1967 | Lentz | 220/323 |

*Primary Examiner*—William Price
*Assistant Examiner*—Allan N. Shoap
*Attorney, Agent, or Firm*—McGlynn and Milton

[57] ABSTRACT

A sealing plug assembly for closing and sealing a cylindrical tubular member, such as an oil fill tube for an internal combustion engine, including a frustum-shaped sealing plug, a support member supporting the sealing plug for complete insertion into the tubular member, a cap member supported by the support member for closing the end of the tubular member and for limiting the amount of travel of the sealing plug into the tubular member, the cap member being spaced apart from the sealing plug, and a device for squarely locating the sealing plug in the tubular member, the locating device including a plurality of spring arms supported by the support member for engaging the walls of the tubular member.

8 Claims, 3 Drawing Figures

SEALING PLUG ASSEMBLY

FIELD OF THE INVENTION

This invention relates to a sealing plug assembly for closing and sealing a cylindrical tubular member, such as an engine oil fill pipe on an internal combustion engine.

BACKGROUND OF THE INVENTION

Sealing plugs of the type referred to herein are employed to seal the engine oil fill pipe of an internal combustion engine, most commonly those used in trucks and heavy-duty equipment. The purpose of the sealing plug is to prevent the escape of oil and fumes from the fill pipe and to prevent foreign objects from entering the fill pipe. Since the sealing plug is used with an internal combustion engine, an important design consideration is that the sealing plug must not vibrate out of the fill pipe. Hence, most users specify a minimum withdrawal force to insure against the sealing plug vibrating loose. As a result, the design of current sealing plugs include relatively elaborate means for wedging the sealing plug in the fill pipe.

One of the most common sealing plugs currently employed includes an expandable generally cylindrical plug body and a device for mechanically expanding the plug body after it is located in the fill pipe. More specifically, the expandable plug body is usually located between a pair of plates which are joined in such a manner that they can be drawn together. This results in a lateral expansion of the plug body against the walls of the fill pipe. The plates are drawn together by means of a threaded member which joins the two plates so that rotation of the threaded member causes relative movement between the plates or a toggle device. Although such sealing plugs function adequately, the use of a threaded member or toggle device for expanding the plug body adds greatly to the manufacturing cost. Additionally, removing and replacing the sealing plug in the fill pipe is inconvenient due to the required manipulation of the device for expanding the plug body.

Another consideration which is becoming increasingly important is that the device for expanding the plug body requires a handle of some type which extends a significant distance out of the sealing plug thus presenting a safety hazard. Recent safety requirements have called for the elimination of such handles.

BRIEF DESCRIPTION OF THE INVENTION

The instant invention provides a sealing plug for fill pipes of combustion engines which eliminates the problems heretofore encountered and is also significantly less expensive to manufacture. More specifically, the sealing plug of the instant invention includes a frustum-shaped sealing plug which is supported on a shaft-like support member for complete insertion into the fill pipe. A cap member is supported on the support member for closing the end of the fill pipe and for limiting the amount of travel of the sealing plug into the fill pipe. The cap member is spaced apart from the sealing plug a sufficient distance to insure complete insertion of the sealing plug into the fill pipe.

It has been found that an exceptionally good seal can be achieved with the frustum-shaped sealing plug as long as the plug is squarely located in the fill pipe. Therefore, the sealing plug assembly includes locating means for serving this function. The locating means comprises a plurality of spring arms supported by the support member and located between the cap member and the sealing plug member for engaging the walls of the fill pipe. The spring arms center and squarely locate the sealing plug in the fill pipe and also resist lateral movement of the support member. In this manner, the frustum-shaped sealing plug is maintained squarely in the fill pipe.

Due to the frustum-shape of the sealing plug insertion of the sealing plug assembly into the fill pipe is relatively easy. However, the sealing plug assembly offers greater resistance to withdrawal than would be expected in view of its relative ease of insertion. The withdrawal force is produced not only from the frictional engagement of the spring arms with the walls of the fill pipe, but also from a wedging action of the sealing plug which is produced when the sealing plug is moved outwardly. When it is desired to remove the sealing plug assembly from the fill pipe, it is necessary to move the support member laterally back and forth to break the seal between the sealing plug and the walls of the fill pipe. This can be accomplished manually by applying sufficient force to deflect the spring arms thus permitting lateral movement of the support member. However, absent an intentional effort to remove the sealing plug assembly from the fill pipe, the sealing plug remains firmly located therein.

DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Referring more particularly to the drawings, a sealing plug assembly constructed in accordance with the instant invention is generally shown at 10.

The sealing plug assembly 10 is used for closing and sealing a cylindrical tubular member, such as an oil fill pipe 12 of an internal combustion engine. The sealing plug assembly 10 includes a frustum-shaped sealing plug 14 which is made of a suitable rubber for the in-service environment. The sealing plug 14 is supported on a support member 16 which comprises a hollow cylindrical member, preferably a length of steel tubing.

Figure 1:
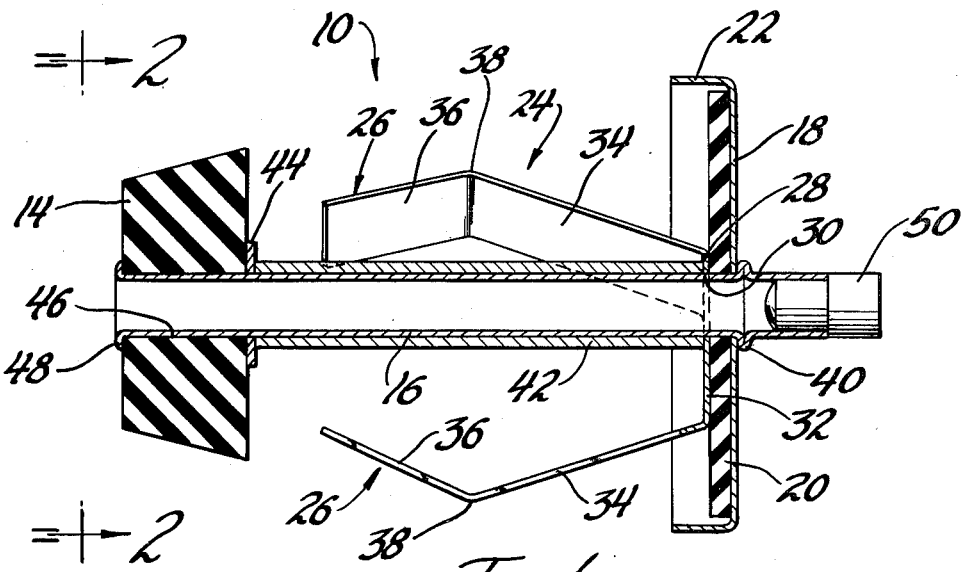
FIG. 1 is a longitudinal cross-sectional view of a sealing plug assembly constructed in accordance with the instant invention.
Figure 2:
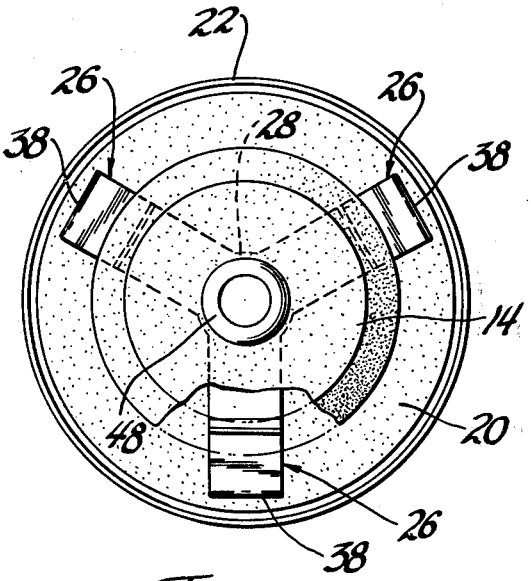
FIG. 2 is a view taken generally along line 2—2 of FIG. 1.
Figure 3:
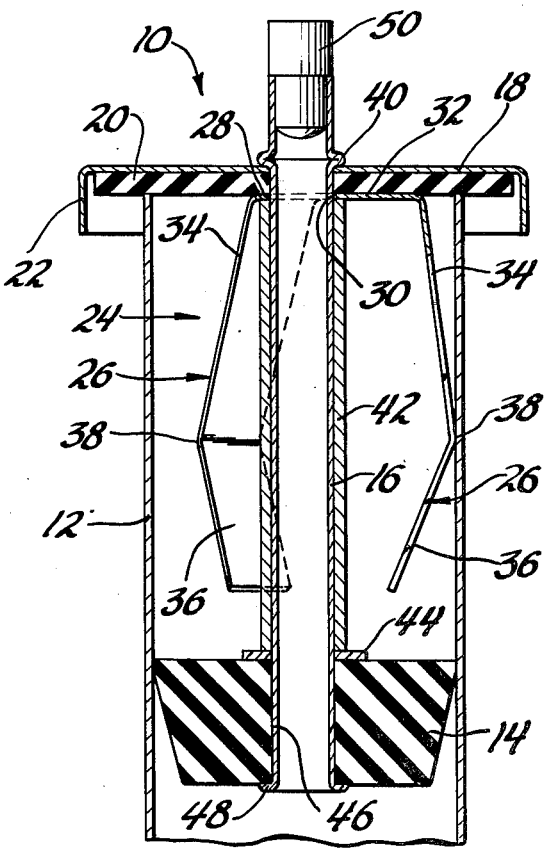
FIG. 3 is a cross-sectional view of the sealing plug assembly shown in FIG. 1 in sealing engagement with a tubular member.

A cap member 18 is also supported by the support member 16 and is spaced apart from the sealing plug 14. In order to permit assembly of the cap member 18 to the support member 16, the cap member includes a centrally located hole which is large enough to receive the support member 16 therethrough. The cap member 18 includes an inwardly facing sealing disc 20 which engages and seals the end of the fill pipe 12. The cap member 18 also includes an annular skirt 22 which surrounds the end of the fill pipe as shown in FIG. 3. The primary purpose of spacing the cap member 18 from the sealing plug 14 is to achieve full insertion of the sealing plug into the end of the fill pipe 12.

The frustum-shaped sealing plug 14 includes tapered sides which converge in a direction away from the cap member 18. The sealing plug 14 is dimensioned so that its largest transverse dimension is slightly greater than the inner diameter of the fill pipe 12. Since the material of which the sealing plug 14 is made is compressible, the sealing plug 14 can be forced into the fill pipe 12. Hence, if the sealing plug 14 is properly oriented with respect to the fill pipe 12, the outer periphery of the sealing plug 14 will sealingly engage the walls of the fill pipe 12.

Correct orientation of the sealing plug 14 is established when the sealing plug 14 is squarely located within the fill pipe 12. This insures proper sealing engagement of the sealing plug 14 with the walls of the fill pipe 12. Additionally, the shape and orientation of the sealing plug 14 causes a surprisingly large withdrawal force. It is believed that this is due to the fact that the edge of the sealing plug which engage the walls of the fill pipe 12 tend to roll under when the sealing plug 14 is moved outwardly. This creates a wedging action between the sealing plug 14 and the fill pipe 12 which resists removal. If, however, the sealing plug 14 is rocked back and forth this wedging effect is eliminated and the sealing plug 14 can be removed relatively easily. Therefore, it is necessary to squarely locate the sealing plug 14 in the fill pipe 12 and to maintain the position of the sealing plug under normal operating conditions.

In order to squarely locate the sealing plug 14 in the fill pipe 12, the assembly 10 includes locating means generally shown at 24. The locating means 24 is positioned between the cap member 18 and the sealing plug 14 and includes three symmetrically-oriented spring arms 26. The spring arms 26 are connected to a hub portion 28 which comprises a generally circular disc-shaped member. The hub 28 includes a circular hole 30 so that it can be fitted onto the support member 16 in the same manner as the cap member 18. Each of the spring arms 26 includes a first portion 32 which radiates outwardly from the hub portion 28, a second portion 34 which extends downwardly and radially outwardly and a third portion 36 which extends downwardly and inwardly. The transition points 38 between the second and third sections 34 and 36 of the spring arms 26 describe a diameter which is greater than the inner diameter of the fill pipe 12. Hence, when the assembly is being inserted into the fill pipe 12, the third or leading sections 34 of the spring arms 26 enter the fill pipe and engage the end of the fill pipe. Further inward movement of the assembly causes the spring arms 26 to flex inwardly to permit complete insertion of the assembly.

The spring arms 26 squarely locate the sealing plug 14 in the fill pipe 12 by locating the upper end of the support member 16 in the center of the fill pipe 12. It should be apparent that since the sealing plug is mounted on the support member 16, lateral movement of the support member 16 changes the orientation of the sealing plug 14 in the fill pipe 12. The spring arms center the support member 16 to properly locate the sealing plug 14 and resiliently resist lateral movement of the support member 16 to maintain the proper orientation of the sealing plug 14 in the fill pipe 12. In this manner, the desired performance of the sealing plug 14 is achieved.

The sealing plug assembly 10 is fabricated by forming an annular bead 40 near the outer end of the tubular support member 16. The annular bead 40 is formed by well-known metal-working techniques. The cap member 18, which is provided with a centrally located circular opening through both the cap member and the seal 20, is fitted on the tubular support member 16 so that it abuts the annular bead 40 as shown. The hub portion 28 of the locating means 24 is then fitted on the support member 16 and is moved against the cap member.

In order to hold the cap member 18 and the locating means 24 in position and to space the sealing plug 14 from these members, a spacer sleeve 42 is employed which is positioned on the tubular support member 16. The spacer sleeve 42 may comprise a piece of steel tubing having an internal diameter slightly larger than the outer diameter of the tubular support member 16. The sealing sleeve 42 is backed up by a washer 44 which is adapted to abut against the sealing plug.

The sealing plug 14 also includes an axial bore 46 for receiving the end of the tubular support member 16. The bore 46 and the sealing plug 14 and the hole in the sealing disc 20 are small enough so that tight sealing engagement between these members and the tubular support member 16 is established. In order to hold all of the members in place on the tubular support member 16 the end of the tubular member is flared to produce a clinched portion 48 which locks the sealing plug 14 in place. This holds all of the other elements in their proper position. A plastic plug 50 is inserted into the end of the tubular support member 16 to complete the assembly. The plug 50 closes the hollow support member 16 to prevent escape of fumes or oil therethrough.

In the event that the assembly calls for a dipstick, it should be apparent that a dipstick blade can be attached to the tubular support member 16 in any suitable manner to produce a combination sealing plug and dipstick assembly.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that the invention may be practiced otherwise than as specifically described herein and yet remain within the scope of the appended claims.

The embodiments of the invention in which an exclusive property or privilege is claimed are defined as follows:

1. A sealing plug assembly for closing and sealing a cylindrical tubular member comprising: a frustum-shaped sealing plug, a support member supporting said sealing plug for complete insertion into the tubular member, a cap member supported by said support member for closing the end of the tubular member and for limiting the amount of travel of said sealing plug into the tubular member, said cap member being spaced apart from said sealing plug, and locating means for squarely locating said sealing plug in said tubular member to maintain the desired orientation of said sealing plug in said tubular member by resisting lateral movement of said support member, said locating means including a plurality of spring arms supported by said support member between said sealing plug and said cap member for engaging the walls of the tubular member.

2. An assembly as set forth in claim 1 wherein said locating means includes a hub member supported by said support member, said spring arms being connected to said hub member and extending therefrom.

3. An assembly as set forth in claim 2 wherein said hub member of said locating means is positioned adjacent said cap member and said spring arms extend generally toward said sealing plug.

4. An assembly as set forth in claim 3 including a spacer sleeve on said support member for maintaining the spacing between said cap member and said sealing plug and for holding said hub member against said cap member.

5. An assembly as set forth in claim 4 wherein said support member includes an annular bead for locating said cap member, said cap member and said locating means being held between said bead and said spacer sleeve.

6. An assembly as set forth in claim 5 wherein the inner end of said support member extends through said sealing plug and includes a clinched end for attaching said sealing plug thereto.

7. An assembly as set forth in claim 6 wherein said support member comprises a hollow cylindrical member and includes a plug member for closing the outer end thereof.

8. An assembly as set forth in claim 7 wherein said cap member includes an inwardly facing sealing disc.

* * * * *